US009323211B2

(12) United States Patent
Matsuno

(10) Patent No.: US 9,323,211 B2
(45) Date of Patent: Apr. 26, 2016

(54) IMAGE FORMING APPARATUS INCLUDING AN OPENING/CLOSING DETECTING DEVICE

(71) Applicant: KYOCERA Document Solutions Inc., Osaka (JP)

(72) Inventor: Akinori Matsuno, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/578,910

(22) Filed: Dec. 22, 2014

(65) Prior Publication Data

US 2015/0185686 A1 Jul. 2, 2015

(30) Foreign Application Priority Data

Dec. 26, 2013 (JP) ..... 2013-269808

(51) Int. Cl.
*G03G 21/00* (2006.01)
*G03G 21/16* (2006.01)
*G03G 15/00* (2006.01)

(52) U.S. Cl.
CPC ..... *G03G 21/1633* (2013.01); *G03G 15/55* (2013.01)

(58) Field of Classification Search
CPC ..... G03G 21/1633
USPC ..... 399/110
See application file for complete search history.

(56) References Cited

U.S. PATENT DOCUMENTS

2005/0169662 A1* 8/2005 Ransom ..... G03G 21/1633 399/110
2009/0214235 A1* 8/2009 Hattori ..... G03G 21/1864 399/37
2015/0093145 A1* 4/2015 Tomatsu ..... G03G 21/1633 399/110
2015/0185686 A1* 7/2015 Matsuno ..... G03G 21/1633 399/110

FOREIGN PATENT DOCUMENTS

JP 2012-159672 A 8/2012

* cited by examiner

*Primary Examiner* — Quana M Grainger
(74) *Attorney, Agent, or Firm* — Studebaker & Brackett PC

(57) ABSTRACT

An image forming apparatus includes an opening/closing member, an opening/closing detecting device and an operating member. The opening/closing member turns integrally with a supporting shaft around the supporting shaft. The opening/closing detecting device detects an opening/closing state of the opening/closing member. The operating member turns integrally with the supporting shaft so as to interlock with turning of the opening/closing member. The operating member includes a pressing part having an external circumference face around the supporting shaft and a relief part having an external circumference face inside a rotation locus of the pressing part. The opening/closing detecting device includes a switch part switching between an ON position depressed by the pressing part in accordance with turning of the operating member, and an OFF position depressing-released by the relief part in accordance with turning of the operating member, and detects the opening/closing state of the opening/closing member by switching the switch part.

11 Claims, 13 Drawing Sheets

IMAGE FORMING APPARATUS INCLUDING AN OPENING/CLOSING DETECTING DEVICE

INCORPORATION BY REFERENCE

This application is based on and claims the benefit of priority from Japanese Patent application No. 2013-269808 filed on Dec. 26, 2013, the entire contents of which are incorporated herein by reference.

BACKGROUND

The present disclosure relates to an image forming apparatus including an opening/closing detecting device detecting an opening/closing state of an opening/closing member.

An image forming apparatus is configured so that a toner container installing part and a sheet conveying part arranged inside the apparatus are opened/closed by an opening/closing member in order to process a replacement of a toner container and a paper jam. In the image forming apparatus including such an opening/closing member, generally, an opening/closing detecting device detecting an opening/closing state of the opening/closing member is arranged in order to prevent the apparatus from starting to operate by mistake in a condition where the opening/closing member is not closed.

A conventional example of the image forming apparatus including the opening/closing member will be described with reference to FIG. 13. In a top end part of an inner face of the opening/closing member 101, a protruding part 102 protruding downwardly is arranged and, in a main body part 103, the opening/closing detecting device 105 is arranged at a corresponding position to the protruding part 102 in a case of closing the opening/closing member 101. In the opening/closing detecting device 105, a depressing-type switch part 104 is arranged. As indicated by a chain line in FIG. 13, when the opening/closing member 101 is closed and the switch part 104 is depressed by the protruding part 102, the opening/closing detecting device 105 is operated to detect a closing state of the opening/closing member 101.

Moreover, an image forming apparatus detecting opening/closing states of two opening/closing members by one opening/closing detecting device is known. In this image forming apparatus, in a center part of an inner face of one opening/closing member and a top end part of an inner face of another opening/closing member, protruding parts are respectively arranged. A switch part of an opening/closing detecting device is configured so as to be depressed by a link mechanism pressed by both the protruding parts.

However, in the conventional image forming apparatus described in FIG. 13, the protruding part 102 depressing the switch part 104 of the opening/closing detecting device 105 is arranged at the top end of the opening/closing member 101. Moreover, in the image forming apparatus detecting the opening/closing states of two opening/closing members by one opening/closing detecting device, each protruding part is arranged at the top end or the center part of the respective opening/closing member.

In such a case where the protruding part depressing the switch part of the opening/closing detecting device is arranged at the top end or the center part of the opening/closing member, a position of the protruding part 102 is easily varied by a warp and torsion of the opening/closing member 101 or dispersion of a dimension of the opening/closing member 101, and therefore, there is possibility that the switch part 104 and link mechanism is not normally depressed. In this case, a problem that a displacement quantity of the switch part 104 and link mechanism is not sufficient and the opening/closing detecting device 105 does not correctly detect the closing state of the opening/closing member 101 is caused.

SUMMARY

In accordance with an embodiment of the present disclosure, an image forming apparatus includes an opening/closing member, an opening/closing detecting device and an operating member. The opening/closing member turns integrally with a supporting shaft around the supporting shaft. The opening/closing detecting device detects an opening/closing state of the opening/closing member. The operating member turns integrally with the supporting shaft. The operating member includes a pressing part and a relief part. The pressing part has an external circumference face in an arc shape around the supporting shaft. The relief part has an external circumference face formed inside a rotation locus of the external circumference face of the pressing part. The opening/closing detecting device includes a switch part configured so as to switch between an ON position, in which the switch part is depressed by the pressing part of the operating member in accordance with turning of the operating member interlocking with turning of the opening/closing member, and an OFF position, in which depressing of the switch part is released by the relief part in accordance with turning of the operating member interlocking with turning of the opening/closing member, and detects the opening/closing state of the opening/closing member by switching the switch part.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

In the following, with reference the drawings, an image forming apparatus according to embodiments of the present disclosure will be described.

Figure 1:
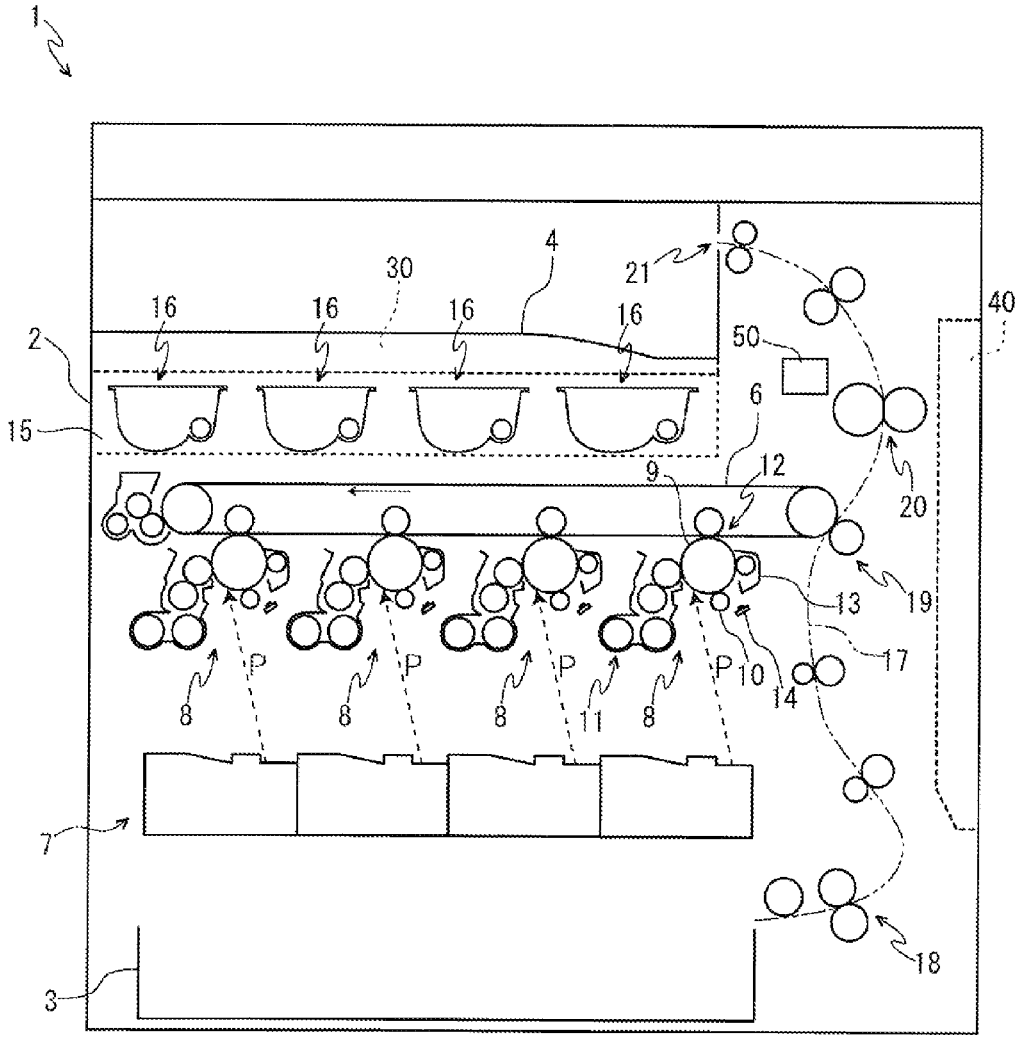
FIG. 1 is a front sectional view schematically showing a structure of a color printer in accordance with a first embodiment of the present disclosure.
Figure 2:
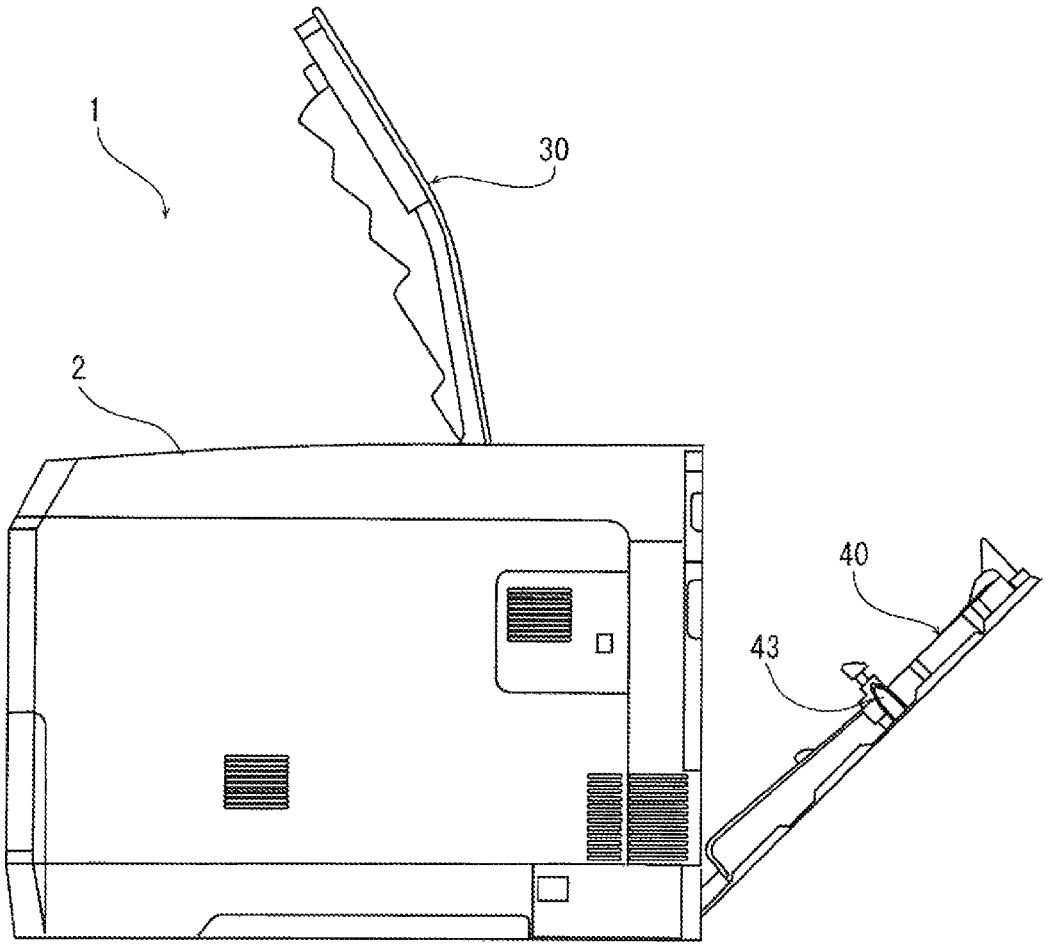
FIG. 2 is a front view showing the color printer, in a condition where an upper face cover and a lateral face cover are opened, in accordance with a first embodiment of the present disclosure.

First, with reference to FIGS. 1 and 2, an entire structure of a color printer 1 (the image forming apparatus) according to a first embodiment of the present disclosure will be described. FIG. 1 is a front view schematically showing a structure of the color printer and FIG. 2 is a front view showing the color printer, in a condition where an upper face cover and a lateral face cover are opened. The structure will be described assuming that the front side of the color printer is positioned at the near side of FIG. 1 and left and right directions are orthogonal to a direction when viewing the color printer from the front side.

The color printer 1 includes a box-formed printer main body 2. In a lower part of the printer main body 2, a sheet feeding cartridge 3 storing sheets (recording mediums) is installed and, in an upper part of the printer main body 2, an ejected sheet tray 4 is provided.

In a center part inside the printer main body 2, an intermediate transferring belt 6 is disposed around a plurality of rollers. Below the intermediate transferring belt 6, an exposure device 7 composed of a laser scanning unit (LSU) is arranged. At a lower side of the intermediate transferring belt 6, four image forming parts 8 are installed for respective colors (e.g. four colors of magenta, cyan, yellow and black) of a toner (a developer). In each image forming part 8, a photosensitive drum 9 is rotatably attached. Around the photosensitive drum 9, a charger 10, a development device 11, a first transferring part 12, a cleaning device 13 and a static eliminator 14 are located in order of first transferring processes. Above the development device 11, a toner container installing part 15 is arranged and toner containers 16 corresponding to the respective image forming parts 8 are arranged in the left and right directions for the respective toner colors. Above the toner container installing part 15, an upper face cover 30 (an opening/closing member) is arranged so as to turn around a right side, in a part of which the ejected sheet tray 4 is formed. When the toner container 16 is replaced, as shown in FIG. 2, the upper face cover 30 can be turned and the toner container installing part 15 can be opened.

At the right side inside the printer main body 2, a conveying path 17 for the sheet is positioned so as to extend vertically from the sheet feeding cartridge 3 to the ejected sheet tray 4. At an upstream end of the conveying path 17, a sheet feeding part 18 is positioned. At an intermediate stream part of the conveying path 17, a second transferring part 19 is positioned at one end (a right end on the figure) of the intermediate transferring belt 6. At a downstream part of the conveying path 17, a fixing part 20 is positioned. At a downstream end of the conveying path 17, an ejection port 21 is positioned. At the right side of the conveying path 17, a lateral side cover 40 (a second opening/closing member) is arranged so as to turn around a lower side. When a paper jam occurs in the conveying path 17, as shown in FIG. 2, the lateral side cover 40 can be turned and the paper jam can be coped.

Next, the operation of forming an image by the color printer 1 having such a configuration will be described. When the power is supplied to the color printer 1, various parameters are initialized and initial determination, such as temperature determination of the fixing part 20, is carried out. Subsequently, in the color printer 1, when image data is inputted and a printing start is directed from a computer or the like connected with the color printer 1, image forming operation is carried out as follows.

First, the surface of the photosensitive drum 9 is electric-charged by the charger 10. Then, an electrostatic latent image is formed on the surface of the photosensitive drum 9 by a laser light (refer to an arrow P) from the exposure device 7. The electrostatic latent image is developed to a toner image having a correspondent color in the development device 11 by the toner supplied from the toner container 16. The toner image is first-transferred onto the surface of the intermediate transferring belt 6 in the first transferring part 12. The above-mentioned operation is repeated in order by the respective image forming parts 8, thereby forming the toner image having full color onto the intermediate transferring belt 6. Incidentally, toner and electric charge remained on the photosensitive drum 9 are removed by the cleaning device 13 and static eliminator 14.

On the other hand, the sheet fed from the sheet feeding cartridge 3 by the sheet feeding part 18 is conveyed to the second transferring part 19 in a suitable timing for the above-mentioned image forming operation. Then, in the second transferring part 19, the toner image having full color on the intermediate transferring belt 6 is second-transferred onto the sheet. The sheet with the second-transferred toner image is conveyed to a downstream side on the conveying path 17 to enter the fixing part 20, and then, the toner image is fixed on the sheet in the fixing part 20. The sheet with the fixed toner image is ejected from the ejection port 21 onto the ejected sheet tray 4.

In the color printer 1, in order to prevent the color printer 1 from starting to operate by mistake in a condition where the upper face cover 30 is not closed, an opening/closing detecting device 50 detecting an opening/closing state of the upper face cover 30 is arranged.

Figure 3:
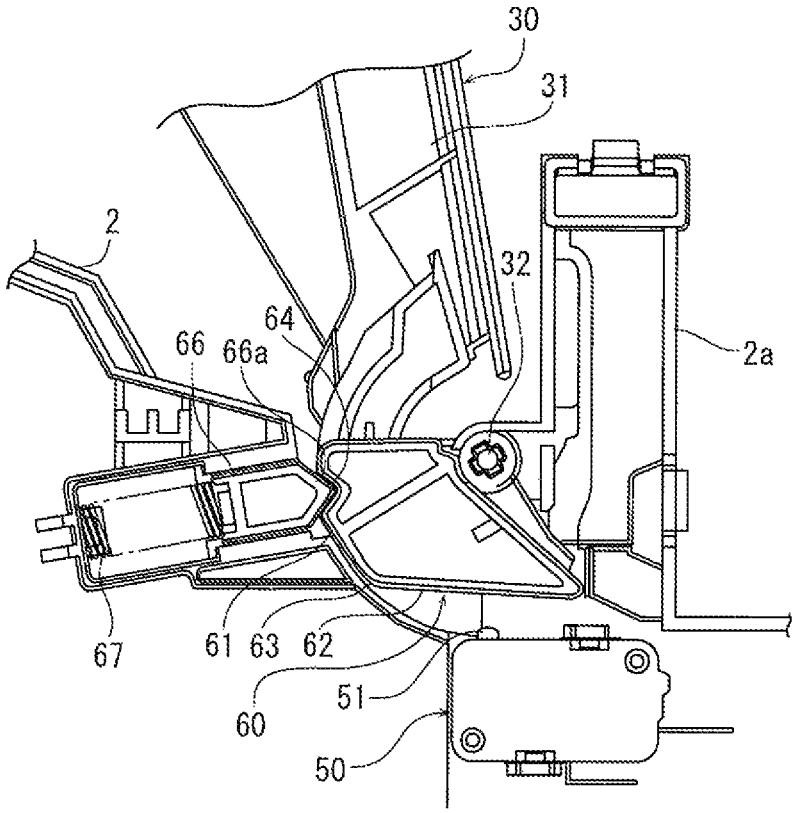
FIG. 3 is a front view showing the upper face cover in an opening state in the color printer in accordance with the first embodiment of the present disclosure.
Figure 4:
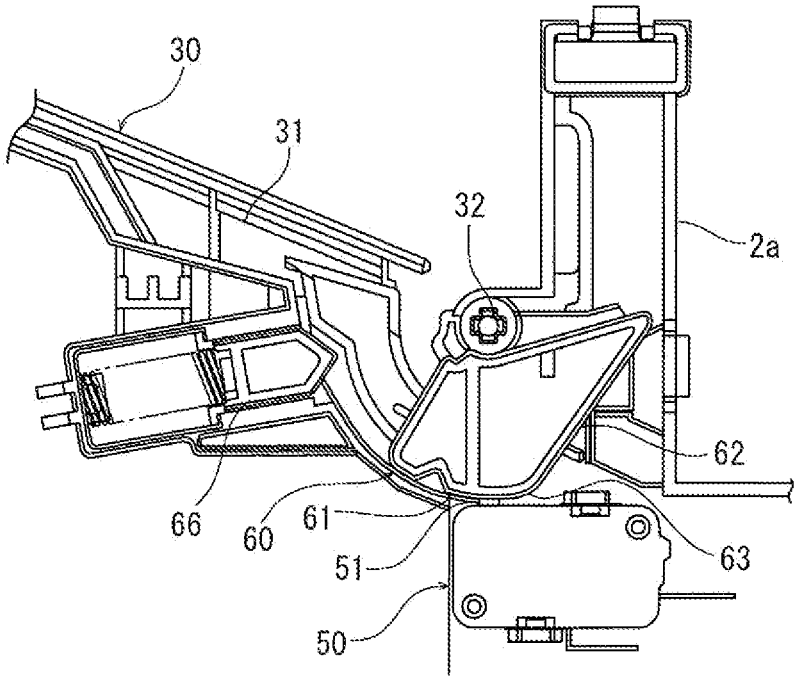
FIG. 4 is a front view showing the upper face cover in a closing state in the color printer in accordance with the first embodiment of the present disclosure.

With reference to FIGS. 3 and 4, the upper face cover 30 and opening/closing detecting device 50 will be described. FIGS. 3 and 4 are front view showing the upper face cover and opening/closing detecting device, and FIG. 3 illustrates an opening state of the upper face cover and FIG. 4 illustrates a closing state of the upper face cover.

The upper face cover 30 includes a flat rectangular parallelepiped main body part 31 and a supporting shaft 32 arranged along a right side of the main body part 31. Both ends of the supporting shaft 32 are rotatably supported by a supporting part **2*a* arranged in the printer main body 2. The main body part 31 is adapted to turn around the supporting shaft 32 between an opening position opening the toner container installing part 15 and a closing position closing the toner container installing part 15**.

In one end of the supporting shaft 32, an operating member 60 operating the opening/closing detecting device 50 is arranged. The operating member 60 is turned integrally with the supporting shaft 32, i.e. integrally with the upper face cover 30. The operating member 60 is a member in a roughly fan-formed front shape around the supporting shaft 32 viewed from the front side with a predetermined thickness.

The operating member 60 includes a pressing part 61 in a fan-formed shape viewed from the front side and a relief part 62 in a triangle shape viewed from the front side. Concretely, the pressing part 61 has an external circumference face in an arc shape around the supporting shaft 32 viewed from the front side. The relief part 62 has an external circumference face in a linear shape viewed from the front side formed inside a rotation locus of the external circumference face of the pressing part 61. The pressing part 61 and relief part 62 are respectively positioned at a downstream side and an upstream side in an opening direction of the upper face cover 30 (a clockwise direction in FIGS. 3 and 4). The external circumference face of the pressing part 61 and the external circumference face of the relief part 62 are smoothly continued via a curved part 63. Near the center in a circumferential direction of the external circumference face of the pressing part 61, a recess part 64 in a V-shape viewed from the front side is formed.

In the printer main body 2, a lock member 66 holding the upper face cover 30 at the opening position is supported. The lock member 66 is a quadrangular prism-formed hollow member and has a top end part 66*a* formed in a V-shape viewed from the front side. The lock member 66 is positioned so as to face to the recess part 64 of the pressing part 61 of the operating member 60 at the opening position of the upper face cover 30 as shown in FIG. 3, and is biased in a direction of the recess part 64 by a coil spring 67. When the upper face cover 30 is turned to the opening position, the lock member 66 is biased by a coil spring 67 and advanced, and then, the top end part 66*a* is engaged with the recess part 64 of the operating member 60. Thereby, the operating member 60, i.e. the upper face cover 30, is held at the opening position. Incidentally, when the upper face cover 30 is closed, the upper face cover 30 is turned to the closing position, and then, the top end part 66*a* of the lock member 66 is pressed by a lateral face of the recess part 64 of the operating member 60 and released from the recess part 64, thereby making the upper face cover 30 turnable from the opening position.

The opening/closing detecting device 50 includes a laterally rectangular parallelepiped main body and, on a left end part of an upper face of the main body, a switch part 51 is positioned. As the switch part 51, for example, a micro switch may be applied. The switch part 51 is an automatic restoration type capable of being depressed by a predetermined load and being restored to a free posture by releasing the depressing. When the switch part 51 is depressed and switched to ON position, the opening/closing detecting device 50 is operated to detect the closing state of the upper face cover 30. When the depressing of the switch part 51 is released to restore to the free posture, the switch part 51 is switched to OFF position and the opening/closing detecting device 50 becomes non-operating state.

The opening/closing detecting device 50 is fixed by the supporting part 2*a* of the printer main body 2 below the supporting shaft 32 of the upper face cover 30 so that the switch part 51 faces to the external circumference face of the operating member 60. The opening/closing detecting device 50 is configured so that, when the operating member 60 is turned together with the turn of the upper face cover 30 and the switch part 51 faces to the external circumference face of the pressing part 61, the switch part 51 is depressed by the pressing part 61 and switched to the ON position, and that, when the upper face cover 30 is turned and the switch part 51 faces to the external circumference face of the relief part 62 of the operating member 60, the depressing of the switch part 51 is released and switched to the OFF position.

In the color printer 1 with the above-mentioned configuration, a way of detecting the opening/closing state of the upper face cover 30 by the opening/closing detecting device 50 will be described. In the opening position of the upper face cover 30 shown in FIG. 3, the operating member 60 is positioned so that the external circumference face of the relief part 62 faces to the switch part 51 of the opening/closing detecting device 50 and the top end part 66*a* of the lock member 66 is engaged with the recess part 64 of the pressing part 61. Therefore, the switch part 51 is positioned at the OFF position and the opening/closing detecting device 50 is not operated. If the upper face cover 30 is started to turn to the closing position, the top end part 66*a* of the lock member 66 is pressed by the lateral face of the recess part 64 of the operating part 60 and released from the recess part 64 and the upper face cover 30 becomes turnable.

When the upper face cover 30 is turned, the operating member 60 is turned together with the supporting shaft 32 and the external circumference face of the pressing face 61 faces to the switch part 51 of the opening/closing detecting device 50 via the curved part 63. Then, as shown in FIG. 4, the external circumference face of the pressing face 61 presses the switch part 51 and the switch part 51 is switched to the ON position. Thereby, the opening/closing detecting device 50 is operated and the closing state of the upper face cover 30 is detected.

As described above, in the image forming apparatus 1 according to the first embodiment of the present disclosure, since the switch part 51 of the opening/closing detecting device 50 is switched by turning the operating member 60 arranged in the supporting shaft 32 turning integrally with the upper face cover 30, it is possible to correctly detect the opening/closing state of the upper cover 30 regardless deformation, such as a warp and torsion, of the main body part 31 of the upper face cover 30.

In the embodiment, since a moving direction of the external circumference face of the pressing face 61 of the operating member 60 is the circumferential direction and is not different from a vertical direction as a direction depressing the switch part 51, it is possible to lengthen a moving stroke of the pressing part 61 more than a depressing stroke of the switch part 51. To stably operate the switch part 51 with a short depressing stroke as the opening/closing detecting device 50 used in the embodiment, it is necessary to improve dimensional accuracy of a member operating the switch part 51 and to increase the stroke via other component. Therefore, by improving the dimensional of a distance between the arc-shaped external circumference face of the pressing face 61 of the operating member 60 and the supporting shaft 32 and by lengthening the moving stroke of the pressing face 61, it is possible to stably depress the switch part 51.

Since the external circumference face of the pressing face 61 has the arc shape, if dispersion of an opening/closing angle of the upper face cover 30 occurs, it is possible to ensure constant depressing amount within a range of a central angle of the pressing face 61.

Since the supporting shaft 32 and opening/closing detecting device 50 are supported by the same supporting part 2*a*, it is easy to achieve positioning accuracy between the operating member 60 and opening/closing detecting device 50 arranged in the supporting shaft 32 and it is possible to improve detecting accuracy of the opening/closing detecting device 50.

Figure 5:
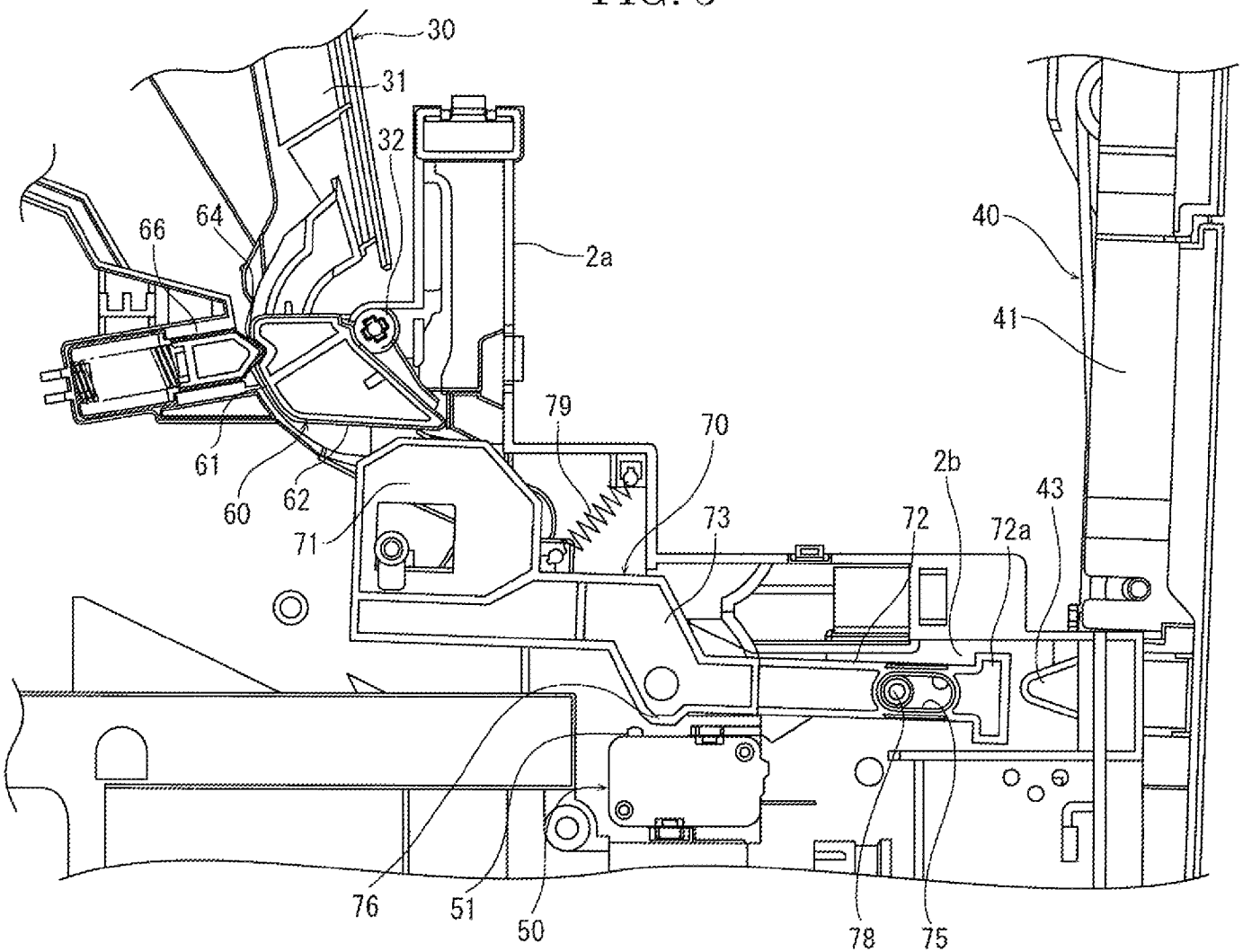
FIG. 5 is a front view showing the color printer, when the upper face cover is in the opening state and the lateral face cover is in the opening state, in accordance with a second embodiment of the present disclosure.
Figure 6:
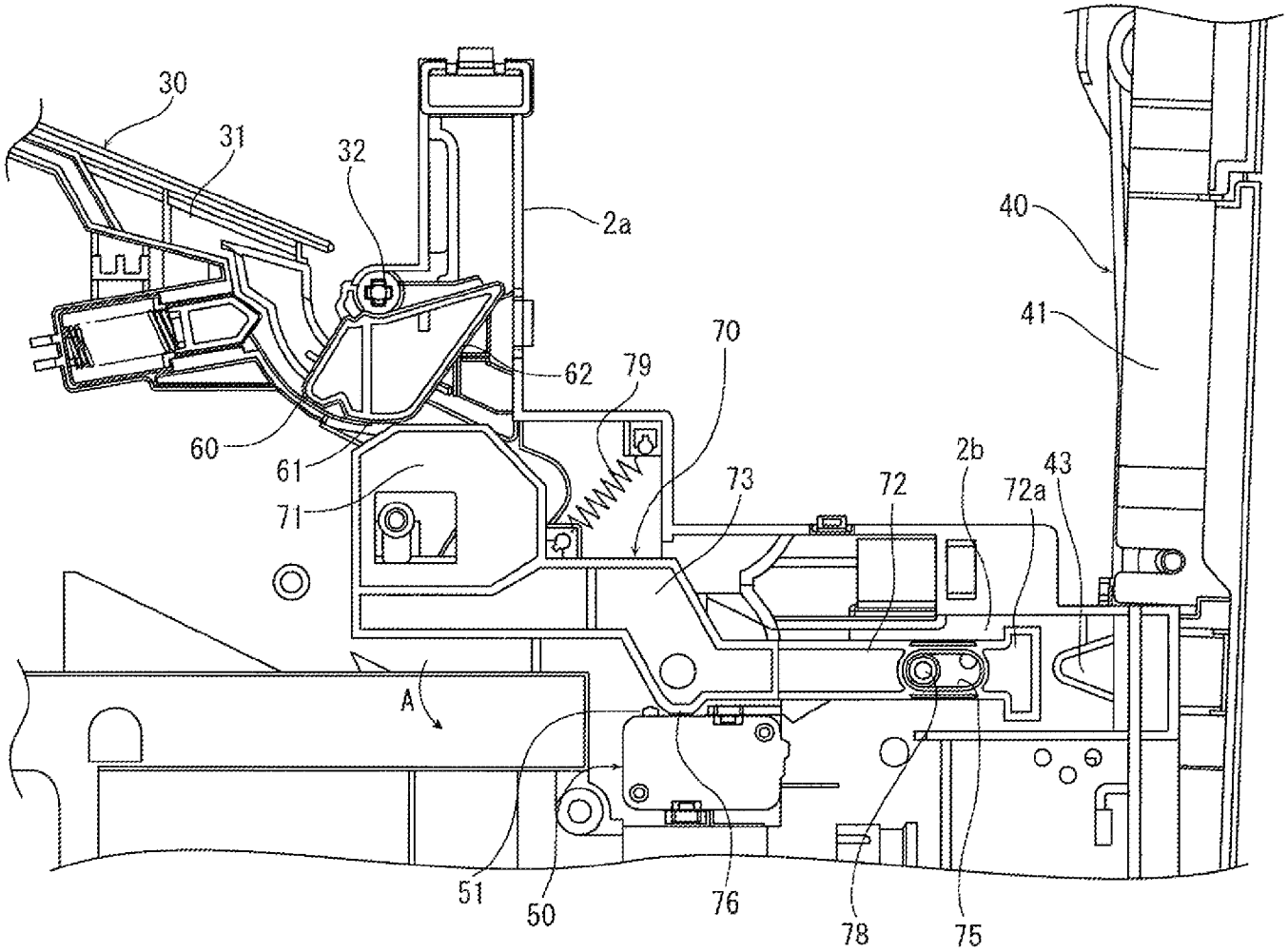
FIG. 6 is a front view showing the color printer, when the upper face cover is in the closing state and the lateral face cover is in the opening state, in accordance with the second embodiment of the present disclosure.
Figure 7:
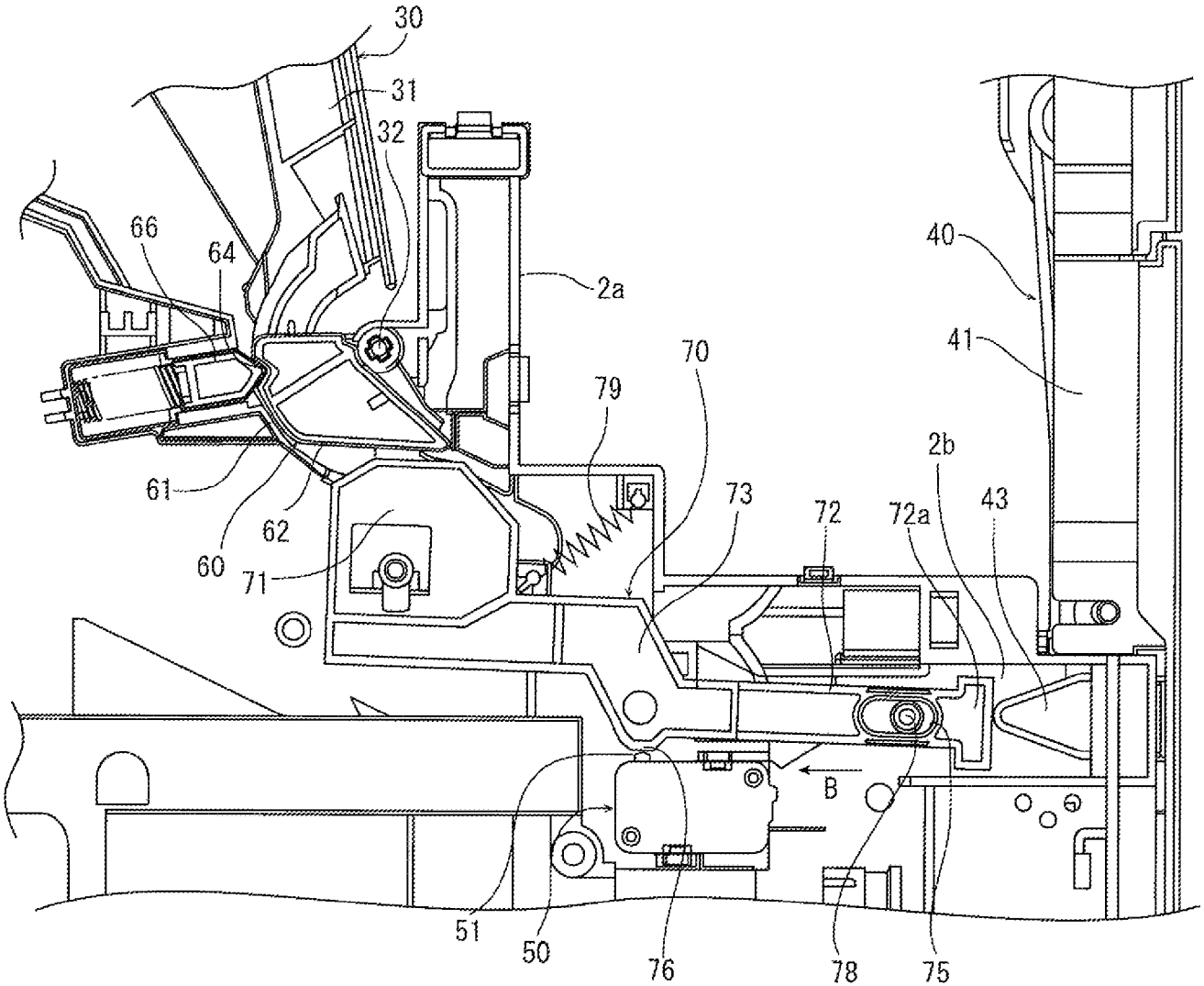
FIG. 7 is a front view showing the color printer, when the upper face cover is in the opening state and the lateral face cover is in the closing state, in accordance with the second embodiment of the present disclosure.
Figure 8:
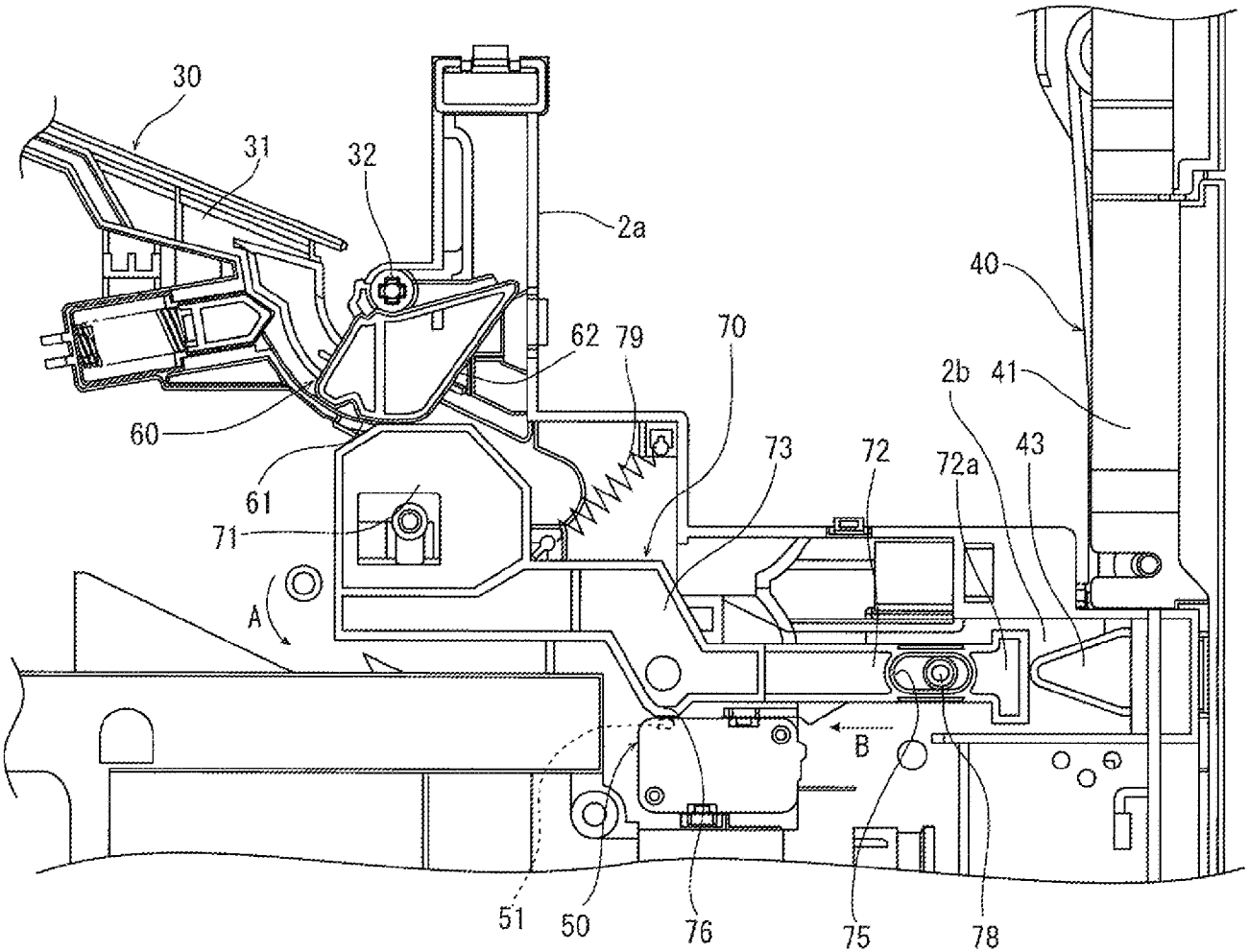
FIG. 8 is a front view showing the color printer, when the upper face cover is in the closing state and the lateral face cover is in the closing state, in accordance with the second embodiment of the present disclosure.

Next, a color printer according to a second embodiment of the present disclosure will be described with reference to FIGS. 5-8. In this embodiment, the opening/closing state of the upper face cover 30 and the opening/closing state of the lateral face cover 40 are detected by one opening/closing detecting device 50. FIG. 5 illustrates the opening position of the upper face cover and an opening position of the lateral face cover, FIG. 6 illustrates the closing position of the upper face cover and the opening position of the lateral face cover, FIG. 7 illustrates the opening position of the upper face cover and a closing position of the lateral face cover, and FIG. 8 illustrates the closing position of the upper face cover and the closing position of the lateral face cover. The upper face cover 30 and opening/closing detecting device 50 have the same structures and shapes as the second embodiment, and therefore, they are indicated by the same reference numerals as the second embodiment and their detail explanations are omitted.

As shown in FIG. 5, the lateral face cover 40 includes a flat rectangular parallelepiped main body part 41 and a supporting shaft (a supporting shaft, not shown) arranged along a lower side of the main body part 41. Both ends of the supporting shaft are rotatably supported by the printer main body 2. As shown in FIG. 2, the main body part 41 is adapted to turn around the supporting shaft between an opening position opening a right side face of the sheet conveying path 17 and a closing position closing the right side face of the sheet conveying path 17. Near the center of an inner face of the main body part 41, a protrusion 43 protruding in an internal direction (a direction closing the right side face of the sheet conveying path 17) is formed. The protrusion 43 has a triangle shape viewed from the front side. In a lateral face of the printer main body 2, an opening part 2*b* is formed, into which the protrusion 43 is inserted when the lateral face cover 40 is turned to the closing position.

Between the supporting part 2*a*, to which the supporting shaft 32 of the upper face cover 30 is supported, and the opening part 2*b*, into which the protrusion 43 of the lateral face cover 40 is inserted, a link member 70 operating by opening/closing the upper face cover 30 and lateral face cover 40 is arranged.

The link member 70 is a member elongated in the left and right directions and includes a first pressed part 71 formed in a roughly rectangular parallelepiped shape viewed from the front side, a second pressed part 72 elongated in the left and right directions and an intermediate part 73 formed in a roughly Z-shape between the first pressed part 71 and second pressed part 72.

The first pressed part 71 has an upper face facing to the external circumference face of the operating member 60 arranged in the supporting shaft 32 of the upper face cover 30. A center part of the upper face of the first pressed part 71 is a flat face and both sides of the center part are inclined downwardly.

The second pressed part 72 is arranged at a depth side (a left side on FIG. 5) inside the opening part 2*b* into which the protrusion 43 of the lateral face cover 40 is inserted. The second pressed part 72 is formed in a lateral T-shape viewed from the front side and, in its right end face, a wide width end part 72*a* is formed. A right end face of the end part 72*a* faces to the protrusion 43 of the lateral face cover 40. At a position at the left side of the second pressed part 72, a long hole 75 elongated in the left and right directions (a horizontal direction) is formed.

On a lower face of the intermediate part 73, a convex part 76 in a reverse trapezoid shape viewed from the front side is formed so as to protrude downwardly.

The link member 70 is supported to the printer main body 2 by a shaft 78 movably inserted into the long hole 75 so as to swing around the shaft 78 and to move along the long hole 75 in the left and right directions. That is, when the upper face of the first pressed part 71 is pressed by the pressing part 61 of the operating member 60, the link member 70 swings around the shaft 78 as a fulcrum in a counter clockwise direction on FIG. 5. When the right end face of the end part 72*a* of the second pressed part 72 is pressed by the protrusion 43 of the lateral face cover 40, the link member 70 moves along the long hole 75 in the left direction.

There is a corner between the first pressed part 71 and intermediate part 73 in the link member 70 and, between the corner and printer main body 2, a coil spring 79 is arranged. The coil spring 79 biases the link member 70 in a clockwise direction around the shaft 78 and in a right direction on FIG. 5.

The opening/closing detecting device 50 is fixed by the supporting part 2*a* of the printer main body 2 below an external circumference face of the intermediate part 73 of the link member 70 and the switch part 51 faces to an external circumference face of the convex part 76 of the intermediate part 73. A displacement quantity of the convex part 76 in upward and downward directions produced by swinging the link member 70 is determined so as to be equal to a displacement quantity (the depressing stroke) of the switch part 51 from the ON position to the OFF position. A movement quantity of the convex part 76 in the left and right directions produced by moving the link member 70 in the left and right directions is determined within a distance between a position, in which the convex part 76 faces to the switch part 51, and another position, in which the convex part 76 is separated from the switch part 51.

In the color printer 1 with the above-mentioned configuration, a way detecting the opening/closing states of the upper face cover 30 and lateral face cover 40 by the opening/closing detecting device 50 will be described. In a case shown in FIG. 5 where the upper face cover 30 is in the opening position and the lateral face cover 40 is in the opening position, the external circumference face of the relief part 62 of the operating part 60 faces to the upper face of the first pressed part 71 of the link member 70 and the lock member 66 is engaged with the recess part 64 of the pressing part 61 of the operating part 60. That is, the first pressed part 71 of the link member 70 is not pressed by the pressing part 61. In addition, the protrusion 43 of the lateral face cover 40 does not come into contact with the end part 72*a* of the second pressed part 72 of the link member 70. That is, the link member 70 is biased in a clockwise direction around the shaft 78 and in a right direction on FIG. 5 by the coil spring 79. Incidentally, if the link member 70 is biased upwardly by the coil spring 79, the first pressed part 71 of the link member 70 is designed so as not to interfere with the relief part 62 of the operating part 60. Therefore, the convex part 76 formed in the intermediate part 73 of the link member 70 is positioned above the switch part 51 of the opening/closing detecting device 50 and separated from the switch part 51 rightward, the switch part 51 is positioned at the OFF position and the opening/closing detecting device 50 is not operated.

In a case shown in FIG. 6 where the upper face cover 30 is in the closing position and the lateral face cover 40 is in the opening position, the pressing part 61 of the operating part 60 presses the first pressed part 71 of the link member 70, the link member 70 swings in a counterclockwise direction around the shaft 78 on FIG. 6 against a biasing force of the coil spring 79 (refer to an arrow A in FIG. 6) and the convex part 76 is lowered by the depressing stroke of the switch part 51. However, since the protrusion 43 of the lateral face cover 40 does not come into contact with the end part 72*a* of the second pressed part 72 of the link member 70 and the link member 70 is biased in a right direction by the coil spring 79, the convex part 76 is separated from the switch part 51 rightward. Therefore, the switch part 51 is positioned at the OFF position and the opening/closing detecting device 50 is not operated.

In a case shown in FIG. 7 where the upper face cover 30 is in the opening position and the lateral face cover 40 is in the closing position, the protrusion 43 of the lateral face cover 40 is inserted into the opening part 2*b* to press the end part 72*a* of the second pressed part 72 of the link member 70, the link member 70 is moved in the left direction against the biasing force of the coil spring 79 (refer to an arrow B in FIG. 7) and the convex part 76 is positioned above the switch part 51. However, since, in the operating part 60, the relief part 62 faces to the first pressed part 71 of the link member 70, the lock member 66 is engaged with the recess part 64 of the pressing part 61 and the link member 70 is not pressed by the operating part 60, the convex part 76 of the link member 70 is positioned above the switch part 51. Therefore, the switch part 51 is positioned at the OFF position and the opening/closing detecting device 50 is not operated.

In a case shown in FIG. 8 where the upper face cover 30 is in the closing position and the lateral face cover 40 is in the closing position, the pressing part 61 of the operating part 60 presses the first pressed part 71 of the link member 70, the link member 70 swings in a counterclockwise direction around the shaft 78 on FIG. 8 (refer to an arrow A in FIG. 8) and the convex part 76 is lowered by the depressing stroke of the switch part 51. In addition, the protrusion 43 of the lateral face cover 40 is inserted into the opening part 2*b* to press the end part 72*a* of the second pressed part 72 of the link member 70, the link member 70 is moved in the left direction against the biasing force of the coil spring 79 (refer to an arrow B in FIG. 8) and the convex part 76 faces to the switch part 51. Therefore, the convex part 76 of the link member 70 depresses the switch part 51 and the switch part 51 is switched to the ON position. Thereby, the opening/closing detecting device 50 is operated to detect the closing states of the upper face cover 30 and lateral face cover 40.

As described above, in the embodiment, since the opening/closing states of the upper face cover 30 and lateral face cover 40 can be detected by one opening/closing detecting device 50, it is possible to reduce the number of components and simplify the configuration of the image forming apparatus.

Moreover, similarly to the first embodiment, in the upper face cover 30, by improving the dimension accuracy of the distance between the arc-shaped external circumference face of the pressing face 61 of the operating member 60 and the supporting shaft 32, the link member 70 can be stably swung, and then, the switch part 51 can be stably depressed. On the other hand, in the lateral face cover 40, by using the link member 70 moving in the left and right directions different from the vertical direction as a direction depressing the switch part 51, it is possible to increase the moving stroke and stably operate the switch part 51 with the short depressing stroke.

Further, since the link member 70 is supported by the supporting part 22*a* similar to the supporting shaft 32 and the opening/closing detecting device 50, it is easy to achieve positioning accuracy among the operating member 60 arranged in the supporting shaft 32, the opening/closing detecting device 50 and the link member 70 and it is possible to improve the detecting accuracy of the opening/closing detecting device 50.

In the second embodiment, the lateral face cover 40 may be configured so as to be supported movably in the horizontal direction in the printer main body 2 by a supporting member and to open/close. In such a configuration, due to the above-mentioned link member 70, the opening/closing detecting device 50 can detect the opening/closing of the upper face cover 30 and lateral face cover 40.

Figure 9:
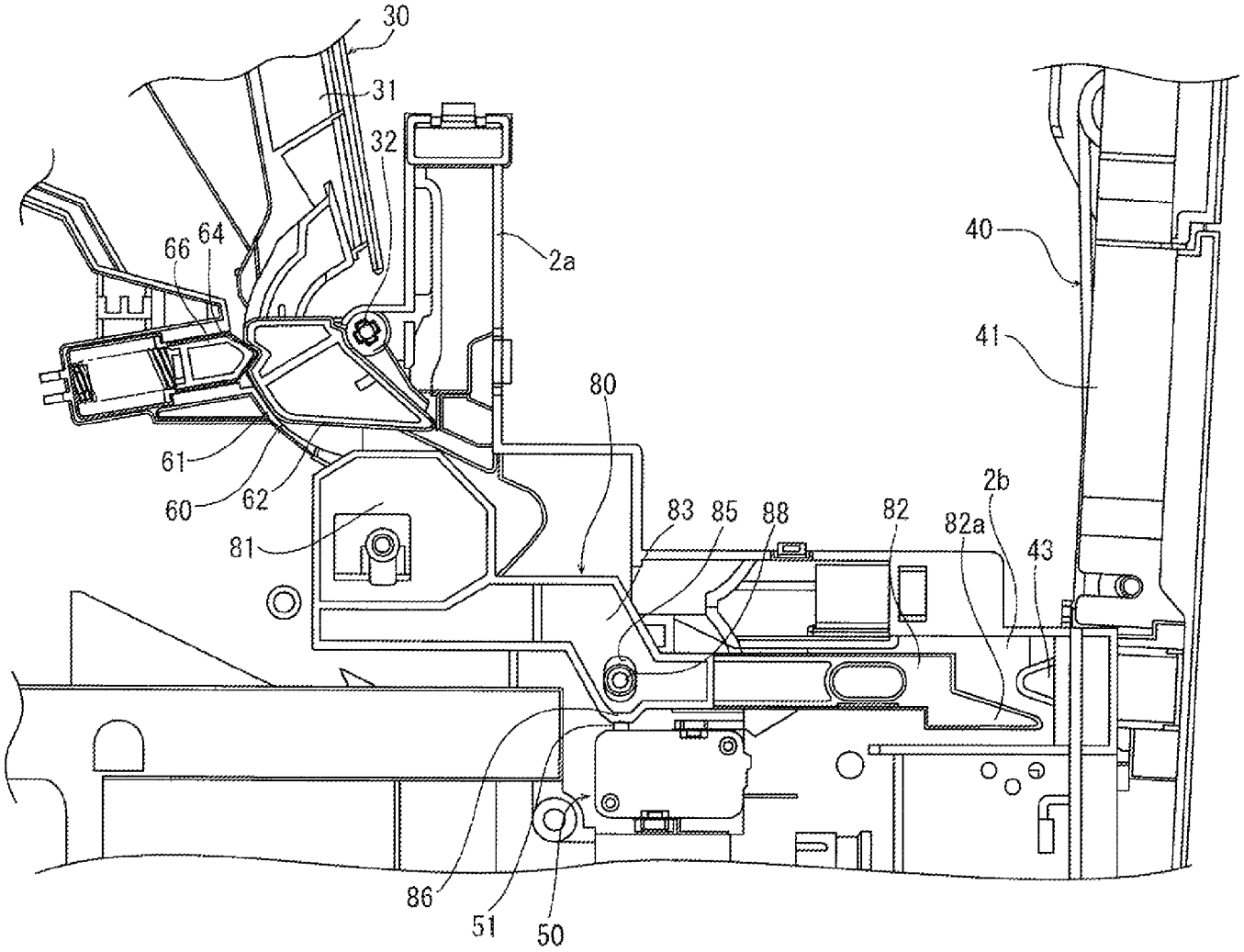
FIG. 9 is a front view showing the color printer, when the upper face cover is in the opening state and the lateral face cover is in the opening state, in accordance with a third embodiment of the present disclosure.
Figure 10:
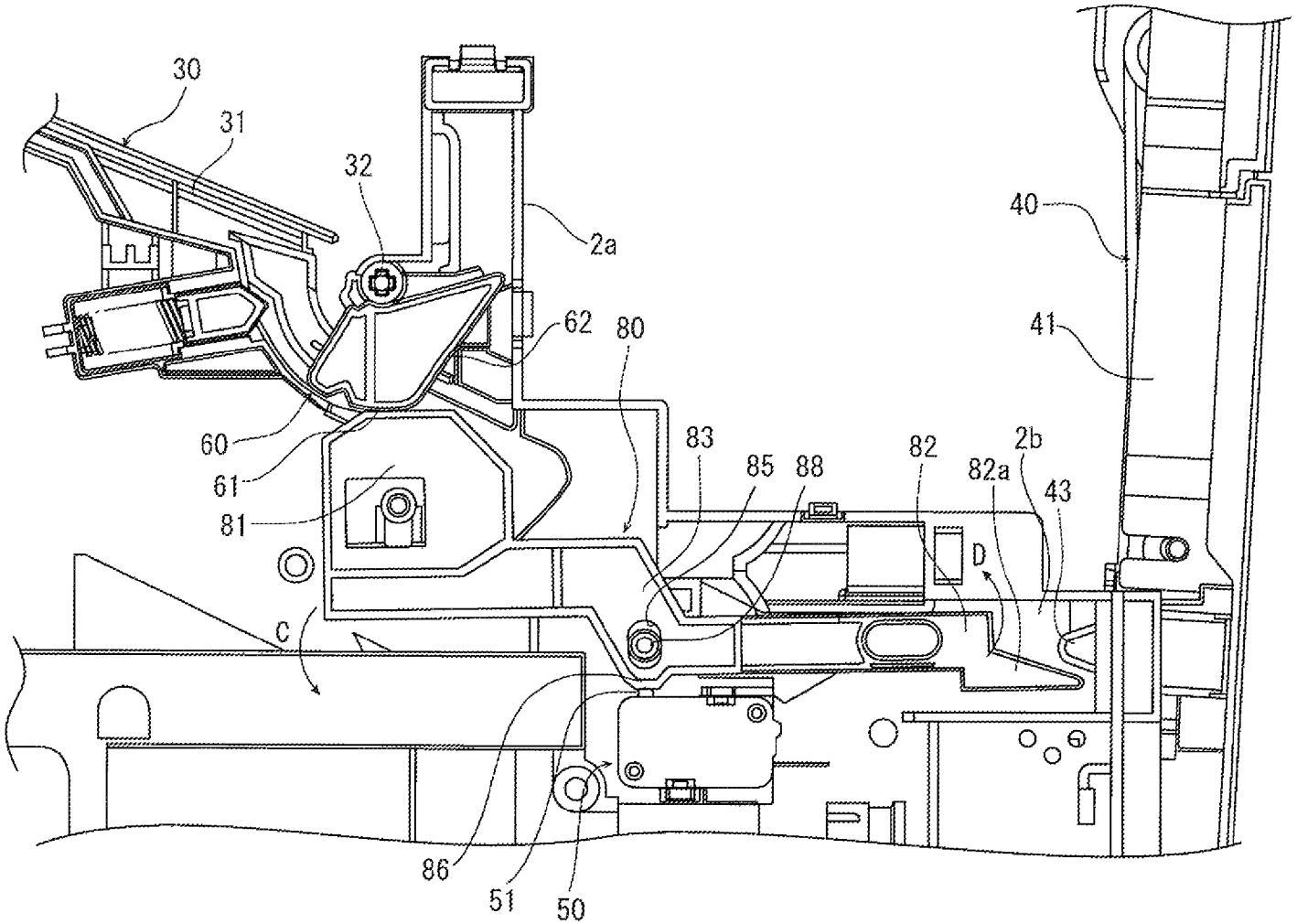
FIG. 10 is a front view showing the color printer, when the upper face cover is in the closing state and the lateral face cover is in the opening state, in accordance with the third embodiment of the present disclosure.
Figure 11:
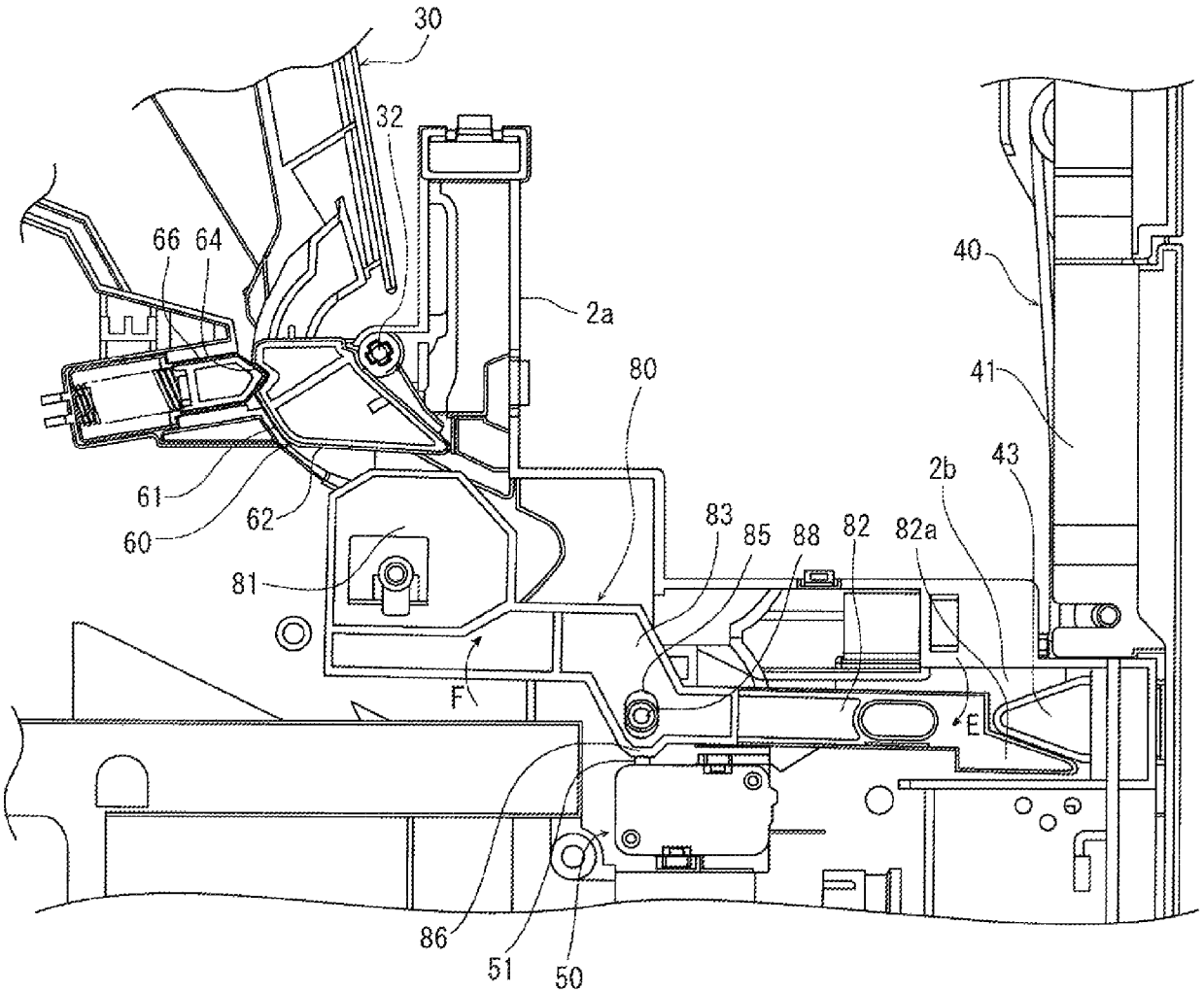
FIG. 11 is a front view showing the color printer, when the upper face cover is in the opening state and the lateral face cover is in the closing state, in accordance with the third embodiment of the present disclosure.
Figure 12:
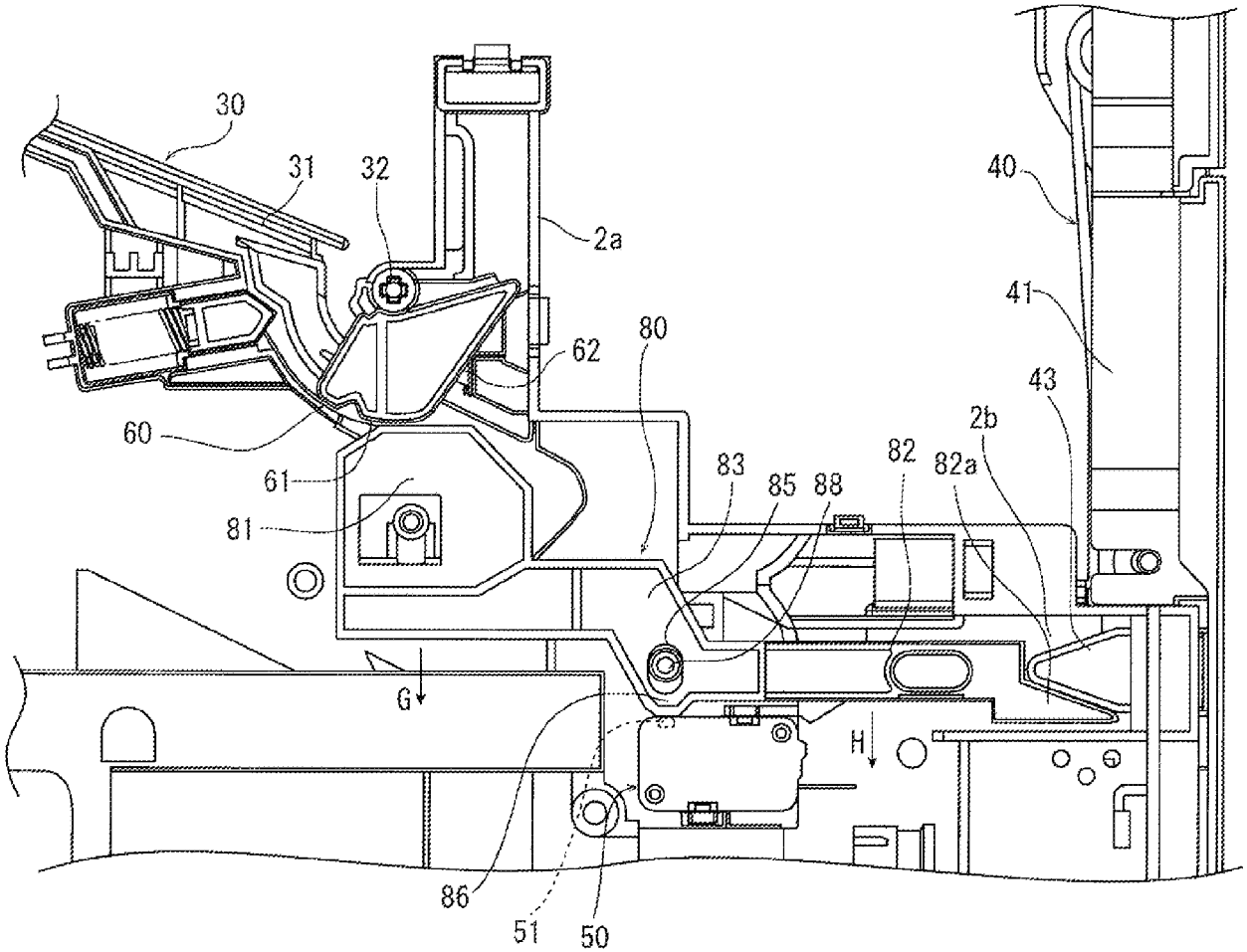
FIG. 12 is a front view showing the color printer, when the upper face cover is in the closing state and the lateral face cover is in the closing state, in accordance with the third embodiment of the present disclosure.
Figure 13:
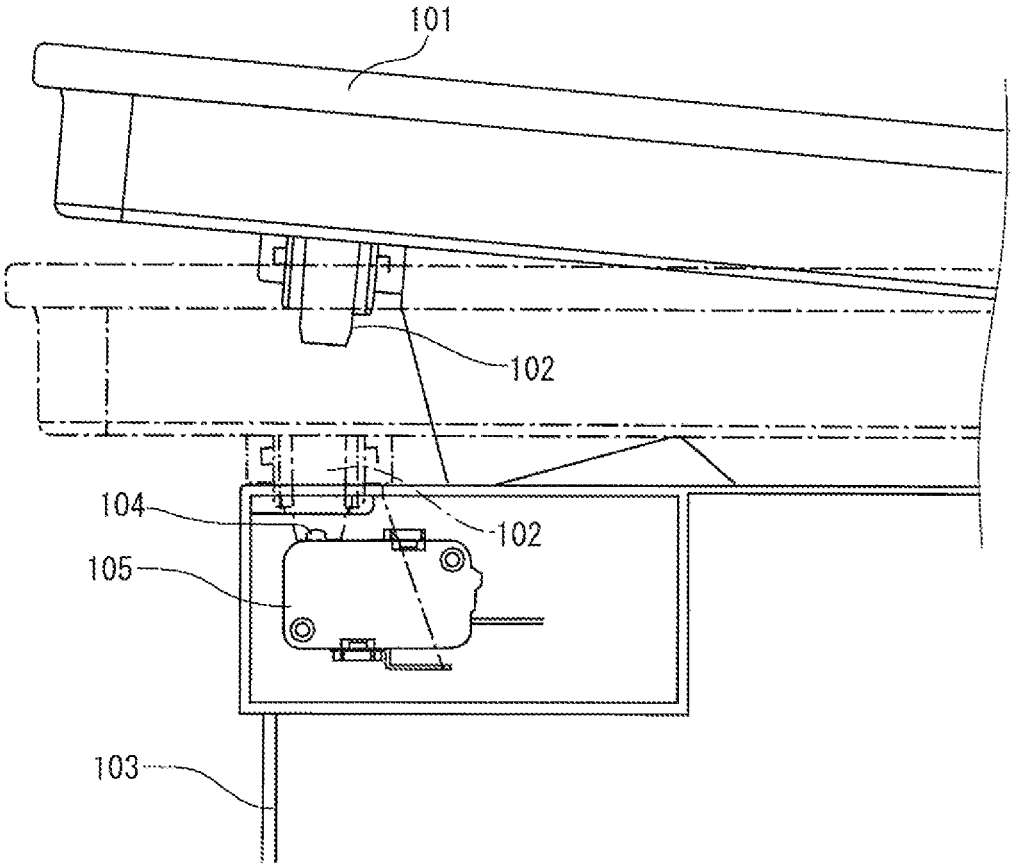
FIG. 13 Related Art
FIG. 13 is a front sectional view showing opening and closing states of an upper face cover of a conventional color printer.

Next, a color printer according to a third embodiment of the present disclosure will be described with reference to FIGS. 9-12. FIG. 9 illustrates the opening position of the upper face cover and an opening position of the lateral face cover, FIG. 10 illustrates the closing position of the upper face cover and the opening position of the lateral face cover, FIG. 11 illustrates the opening position of the upper face cover and a closing position of the lateral face cover, and FIG. 12 illustrates the closing position of the upper face cover and the closing position of the lateral face cover. The upper face cover 30, lateral face cover 40 and opening/closing detecting device 50 have the same structures and shapes as the second embodiment, and therefore, they are indicated by the same reference numerals as the second embodiment and their detail explanations are omitted.

The link member 80 is a member elongated in the left and right directions and includes a first pressed part 81 formed in a roughly rectangular parallelepiped shape viewed from the front side, a second pressed part 82 elongated in the left and right directions and an intermediate part 83 formed in a roughly Z-shape between the first pressed part 81 and second pressed part 82.

The first pressed part 81 has an upper face facing to the external circumference face of the operating member 60 arranged in the supporting shaft 32 of the upper face cover 30. A center part of the upper face of the first pressed part 81 is a flat face and both sides of the center part are inclined downwardly.

The second pressed part 82 is arranged inside the opening part 2*b* into which the protrusion 43 of the lateral face cover 40 is inserted. In a corner between a right end face and a lower face of the second pressed part 82, an end part 82*a* with a triangle shape viewed from the front side is formed to protrude in the right direction. The top end part 82*a* has an inclined face inclined downwardly in the right direction. The inclined face of the top end part 82*a* faces to the lower face of the protrusion 43 of the lateral face cover 40.

Near the center of the intermediate part 83, a long hole 85 elongated in the upward and downward directions is formed. In a lower face of the intermediate part 83, a convex part 86 in a reverse trapezoid shape viewed from the front side is formed so as to protrude downwardly.

The link member 80 is supported to the printer main body 2 by a shaft 88 movably inserted into the long hole 85 so as to swing around the shaft 88, e.g. to do seesaw movement, and to move along the long hole 85 in the upward and downward directions. That is, when the first pressed part 81 is pressed by the pressing face 61 of the operating member 60 arranged in the supporting shaft 32 of the upper face cover 30, the link member 80 works as the seesaw movement around the shaft 88 so that the first pressed part 81 is lowered and the second pressed part 82 is raised. In addition, when the inclined face of the end part 82*a* of the second pressed part 82 is pressed by the protrusion 43 of the lateral face cover 40, the link member 80 works as the seesaw movement around the shaft 88 so that the second pressed part 82 is lowered and the first pressed part 81 is raised.

The opening/closing detecting device 50 is fixed by the supporting part 2*a* of the printer main body 2 below an external circumference face of the intermediate part 83 of the link member 80 and the switch part 51 comes in contact with a lower face of the convex part 86 of the intermediate part 83. The switch part 51 is configured so as to be depressed only when a predetermined load is applied, but the switch part 51 is not depressed only by an empty weight of the link member 80.

In the color printer 1 with the above-mentioned configuration, a way detecting the opening/closing states of the upper face cover 30 and lateral face cover 40 by the opening/closing detecting device 50 will be described. In a case shown in FIG. 9 where the upper face cover 30 is in the opening position and the lateral face cover 40 is in the opening position, the external circumference face of the relief part 62 of the operating part 60 faces to the upper face of the first pressed part 81 of the link member 80 and the lock member 66 is engaged with the recess part 64 of the pressing part 61 of the operating part 60, and therefore, the link member 80 is not pressed by the pressing part 61. In addition, the protrusion 43 of the lateral face cover 40 does not come into contact with the end part 82*a* of the second pressed part 82 of the link member 80. Therefore, since the convex part 86 formed in the intermediate part 83 of the link member 80 comes into contact with the switch part 51, but does not depress the switch part 51, the switch part 51 is positioned at the OFF position and the opening/closing detecting device 50 is not operated.

In a case shown in FIG. 10 where the upper face cover 30 is in the closing position and the lateral face cover 40 is in the opening position, the pressing part 61 of the operating part 60 presses the first pressed part 81 of the link member 80, but the protrusion 43 of the lateral face cover 40 does not come into contact with the end part 82*a* of the second pressed part 82 of the link member 80. According to this, the link member 80 works as the seesaw movement around the shaft 88 so that the first pressed part 81 is lowered and the second pressed part 82 is raised (refer to arrows C and D in FIG. 10), while keeping a posture placed on the switch part 51 of the opening/closing detecting device 50. Therefore, since the convex part 86 of the link member 80 comes into contact with the switch part 51, but does not depress the switch part 51, the switch part 51 is positioned at the OFF position and the opening/closing detecting device 50 is not operated.

In a case shown in FIG. 11 where the upper face cover 30 is in the opening position and the lateral face cover 40 is in the closing position, the protrusion 43 of the lateral face cover 40 is inserted into the opening part 2*b* to press the top end part 82*a* of the second pressed part 82 of the link member 80, but the relief part 62 faces to the first pressed part 81 of the link member 80 and the lock member 66 is engaged with the recess part 64 of the pressing part 61. According to this, the link member 80 works as the seesaw movement around the shaft 88 so that the second pressed part 82 is lowered and the first pressed part 81 is raised (refer to arrows E and F in FIG. 11), while keeping a posture placed on the switch part 51 of the opening/closing detecting device 50. Therefore, since the convex part 86 of the link member 80 comes into contact with the switch part 51, but does not depress the switch part 51, the switch part 51 is positioned at the OFF position and the opening/closing detecting device 50 is not operated.

In a case shown in FIG. 12 where the upper face cover 30 is in the closing position and the lateral face cover 40 is in the closing position, the pressing part 61 of the operating part 60 presses the first pressed part 81 of the link member 80 and the protrusion 43 of the lateral face cover 40 is inserted into the opening part 2*b* to press the end part 82*a* of the second pressed part 82 of the link member 80. According to this, the first pressed part 81 of the link member 80 is pressed by the pressing part 61 to be lowered and the second pressed part 82 is pressed by the protrusion 43 to be lowered (refer to arrows G and H in FIG. 12). That is, the link member 80 is lowered along the long hole 85 and the convex part 86 of the link member 80 depresses the switch part 51. Thereby, the opening/closing detecting device 50 is switched to the ON position to detect the closing states of the upper face cover 30 and lateral face cover 40.

As described above, in the embodiment, since the opening/closing states of the upper face cover 30 and lateral face cover 40 can be detected by one opening/closing detecting device 50, it is possible to reduce the number of components and simplify the configuration of the image forming apparatus.

In the embodiment, the lateral face cover 40 may be configured so as to be supported movably in the horizontal direction in the printer main body 2 by a supporting member and to open/close.

Since a distance between the second pressed part 82 as a force point and the shaft 88 as a fulcrum in the seesaw movement of the link member 80 around the shaft 88 is relatively lengthened, it is possible to increase a moving stroke of the second pressed part 82 and stably operate the switch part 51.

Since the switch part 51 of the opening/closing detecting device 50 is not depressed without applying the predetermined load, a biasing member, such as a coil spring, biasing upwardly the link member 80 is no longer required. However, the biasing member may be provided. In such a case, the biasing member may be arranged so that both sides of the shaft 88 of the link member 80 are biased upwardly.

The embodiments of the present disclosure were described in a case of applying the configuration of the present disclosure to the color printer 1. On the other hand, in another embodiment, the configuration of the disclosure may be applied to another image forming apparatus, such as a copying machine, a facsimile or a multifunction peripheral, except for the color printer 1.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. An image forming apparatus comprising:

an opening/closing member turning integrally with a supporting shaft around the supporting shaft;

an opening/closing detecting device detecting an opening/closing state of the opening/closing member; and an operating member turning integrally with the supporting shaft, wherein the operating member includes:

a pressing part having an external circumference face in an arc shape around the supporting shaft; and a relief part having an external circumference face formed inside a rotation locus of the external circumference face of the pressing part, the opening/closing detecting device includes a switch part configured so as to switch between an ON position, in which the switch part is depressed by the pressing part of the operating member in accordance with turning of the operating member interlocking with turning of the opening/closing member, and an OFF position, in which depressing of the switch part is released by the relief part in accordance with turning of the operating member interlocking with turning of the opening/closing member, and detects the opening/closing state of the opening/closing member by switching the switch part.

2. The image forming apparatus according to claim 1, wherein the supporting shaft and the opening/closing detecting device are supported by the same supporting part.

3. The image forming apparatus according to claim 1, wherein the pressing part of the operating member is configured to be turned in an orthogonal direction to a depressing direction of the switch part of the opening/closing detecting device.

4. The image forming apparatus according to claim 1, further comprising:

a second opening/closing member arranged turnably around a second supporting shaft integrally with the second supporting shaft or movably in a predetermined direction by a supporting member, in which its opening/closing state is detected by the opening/closing detecting device; and a link member including a first pressed part, which is pressed by the pressing part of the operating member in accordance with turning of the operating member interlocking with turning of the opening/closing member and in which pressing is released by the relief part in accordance with turning of the operating member interlocking with turning of the opening/closing member, and a second pressed part pressed by the second opening/closing member, wherein the opening/closing detecting device is configured so that the switch part is switched to the On position to detect the closing state of the opening/closing member and second opening/closing member when the first pressed part of the link member is pressed by the pressing part of the operating member and the second pressed part of the link member is pressed by the second opening/closing member.

5. The image forming apparatus according to claim 4, wherein the second pressed part is pressed in an orthogonal direction to a depressing direction of the switch part of the opening/closing detecting device.

6. The image forming apparatus according to claim 4, wherein the link member includes a long hole elongated in a horizontal direction and is configured so as to swing downwardly around a shaft, inserted into the long hole, by the first pressed part pressed by the pressing part of the operating member and to move along the long hole in the horizontal direction by the second pressed part pressed by the second opening/closing member, and then to switch the switch part to the ON position when both the first pressed part and the second pressed part are pressed.

7. The image forming apparatus according to claim 4, wherein the link member includes a long hole elongated in upward and downward directions and is configured so as to swing as a seesaw around a shaft, inserted into the long hole, by the first pressed part pressed by the pressing part of the operating member or the second pressed part pressed by the second opening/closing member and to move along the long hole downwardly by the first pressed part pressed by the pressing part of the operating member and the second pressed part pressed by the second opening/closing member, and then to switch the switch part to the ON position when both the first pressed part and the second pressed part are pressed.

8. The image forming apparatus according to claim 4, further comprising a biasing member biasing the link member in an opposite direction to a direction in which the first pressed part and second pressed part are pressed.

9. The image forming apparatus according to claim 4, wherein the link member is supported by the same supporting part to which the supporting shaft and the opening/closing detecting device are supported.

10. The image forming apparatus according to claim 1, further comprising a lock member locking the operating member in an unturnable state at the opening position of the opening/closing member.

11. The image forming apparatus according to claim 4, wherein the switch part of the opening/closing detecting device is configured so that depressing or releasing of the depressing is made by a convex part arranged in an intermediate part between the first pressed part and second pressed part of the link member.

* * * * *